US005309829A

United States Patent [19]

Gahlmann et al.

[11] Patent Number: 5,309,829

[45] Date of Patent: May 10, 1994

[54] APPARATUS FOR PRODUCING JUICE FROM A FRUIT MASH

[75] Inventors: Martin Gahlmann, Freudenberg; Michael Schmidt, Betzdorf; Erhard Kohles, Wissen, all of Fed. Rep. of Germany

[73] Assignee: Alb. Klein GmbH & Co. KG, Niederfischbach, Fed. Rep. of Germany

[21] Appl. No.: 29,561

[22] Filed: Mar. 11, 1993

[30] Foreign Application Priority Data

Apr. 28, 1992 [DE] Fed. Rep. of Germany ..... 4213843

[51] Int. Cl.[5] ..... B30B 9/24

[52] U.S. Cl. ..... 100/118; 100/151; 210/386; 210/401

[58] Field of Search ..... 100/118–120, 100/151, 152; 210/386, 401

[56] References Cited

U.S. PATENT DOCUMENTS 3,630,158 12/1971 Doornhof ..... 100/118
3,796,149 3/1974 Heissenberger ..... 100/118
3,922,963 12/1975 Sanderson ..... 100/118
4,236,445 12/1980 Sernagiotto et al. ..... 100/118
4,557,833 12/1985 Krenmayer et al. ..... 100/118 X
4,681,033 7/1987 Crandall et al. ..... 100/118
4,885,088 12/1989 Sbaschnigg ..... 100/120 X

FOREIGN PATENT DOCUMENTS 2551127 5/1976 Fed. Rep. of Germany ..... 210/386

*Primary Examiner*—Stephen F. Gerrity
*Attorney, Agent, or Firm*—Bachman & LaPointe

[57] ABSTRACT

An apparatus for producing juice from a layer of fruit mash including circulating screening belts of a screening belt press, which are guided around drums or rollers of at least one pressing zone jointly forming a meander-like pressing path. The screening belts are guided in a high-pressure pressing zone between at least one pair of stationary pressing rollers and around a pressure roller which is radially movable relative to the pressing rollers. In the pressing position the pressure roller forms a line pressure gap with each of the flanking pressing rollers which acts on the cross-section of the layer of fruit mash.

11 Claims, 2 Drawing Sheets

APPARATUS FOR PRODUCING JUICE FROM A FRUIT MASH

BACKGROUND OF THE INVENTION

The invention concerns an apparatus for producing juice from a layer of fruit mash, which is arranged between circulating screening belts of a screening belt press, wherein the screening belts are guided around drums or rollers of at least one pressing zone jointly forming a meander-like pressing path.

Such an apparatus for producing juice is to be found for example in German laid-open application (DE-OS) No 35 07 502, comprising a screening belt press and pressing zones. The pressing zones are disposed upstream of a discharge gap drums in mutually in which are disposed a plurality of displaced relationship which guide two screening belts. The diameters of the drums decrease in the direction of conveying movement.

Juice extraction apparatuses are known having pressing zones with very high pressing pressures, which the respective press can provide and to which the fruit mash is exposed after it has already been put into a stable condition in respect of pressing, by virtue of substantial extraction of juice. Screening belts with the fruit mash enclosed therebetween are usually guided in the pressing zone around stationary pressing rollers of the smallest possible diameter, as a small roller diameter involves a high pressing pressure.

In regard to juice extraction in relation to various foodstuffs, in particular apples, the important consideration is essentially achieving the highest possible juice yield by virtue of a slow and continuous rise in pressure applied to the fruit mash from which juice is to be extracted.

With knowledge of that state of the art, the inventor set himself the aim of so improving an apparatus of the kind discussed above that it provides a higher yield and also makes it possible to save on one or other of the rollers.

SUMMARY OF THE INVENTION

The object is attained in accordance with the teaching of the present invention.

The present invention comprises an apparatus for producing juice from a layer of fruit mash, which is arranged between circulating screening belts of a screening belt press, wherein the screening belts are guided around drums or rollers of at least one pressing zone jointly forming a meander-like pressing path. The screening belts are guided in a high-pressure pressing zone between at least one pair of stationary pressing rollers around pressure roller which is radially movable relative to the pressing rollers, and in a pressing position the pressure roller forms with each of the flanking pressing rollers a line pressure gap which acts on the cross-section of the layer of fruit mash.

BRIEF DESCRIPTION OF THE DRAWINGS

Further advantages, features and details of the invention will be apparent from the following description of a preferred embodiment and with reference to the drawings in which.

DETAILED DESCRIPTION OF PREFERRED EMBODIMENTS

Figure 1:
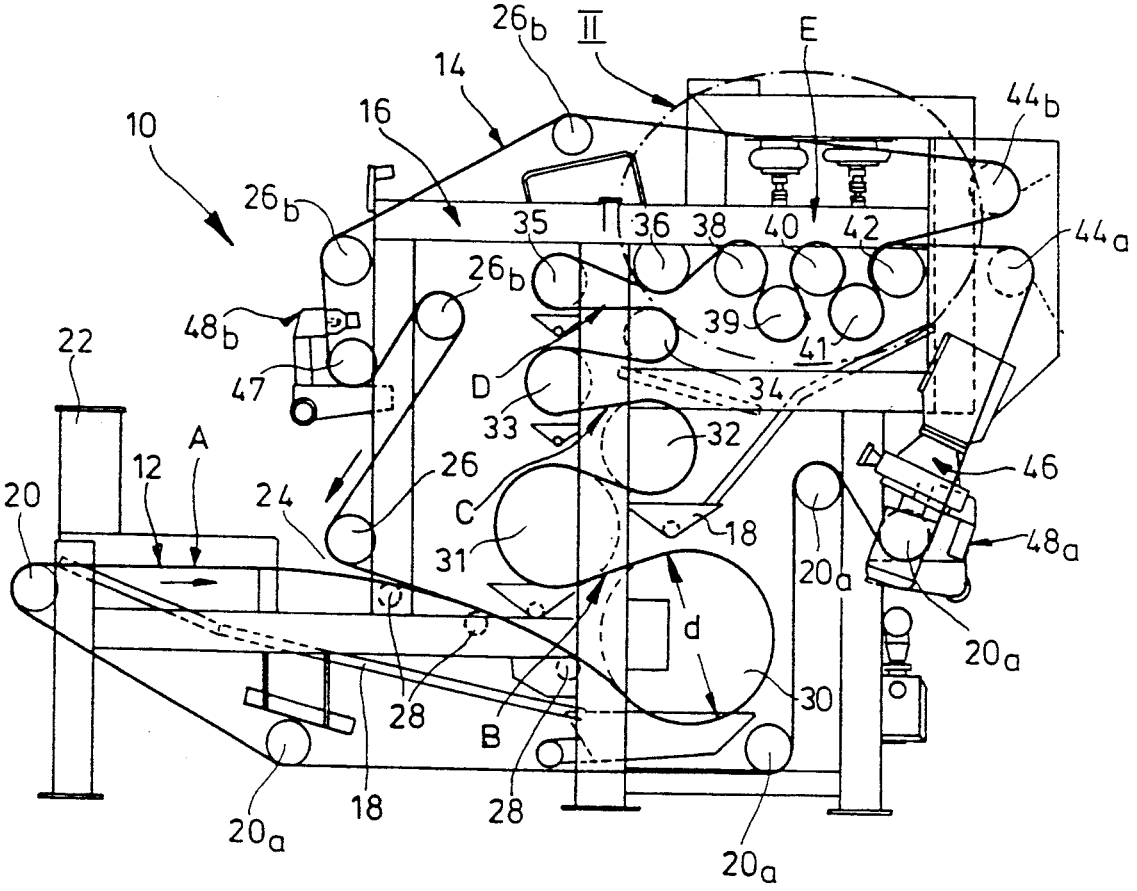
FIG. 1 is a diagrammatic side view of a screening belt press with a high-pressure pressing zone.

In accordance with the invention the screening belts are guided in a so-called high-pressure zone between at least one pair of stationary pressing rollers in a loop-like configuration around a pressure roller which is movable radially relative to the pressing rollers. In a pressing position the pressure roller forms with each of the pressing rollers a line pressure gap which acts on the cross-section of the layer of fruit mash and which is variable in respect of its width. A plurality of such groups comprising two stationary pressing rollers and a pressure roller which is movable relative thereto are also in accordance with the invention.

Line pressure gaps are known per se. In screening belt presses they are provided by pressing rollers which act from the outside and which therefore do not have the screening belts looping around them and which are pressed against the rollers around which the screening belts pass, for example by means of pneumatic cylinder units. However such arrangements do not result in the attainment of the object envisage by the present invention.

In accordance with a further feature of the invention the pressure roller is moved from its rest position, which is determined by its own weight and in which it is disposed at a spacing relative to the flanking pressing rollers, into the pressing position by the tension of the circulating screening belts. More specifically, when the fruit press is switched on, and when that happens the screening belts are tensioned, then in accordance with the invention, by virtue of the belt tension, the pressure rollers move in a vertical plane out of their rest position towards the pair of pressing rollers. The above-discussed line pressure gaps are produced in the region of a belt loop. The screening belts have to squeeze through the line pressure gap and the enclosed layer of fruit mash changes its cross-section.

A situation may arise wherein when the belt tension is increased, the forces in the line pressure gap are greater than the drive forces, in which case the screening belts come to a halt. In order to prevent this situation from arising the apparatus has pneumatic bellows cylinders which are described in greater detail hereinafter, with guide bars or rods and adjusting devices, and apertured arresting plates or like arresting surfaces, with which defined spacings are produced between the pressure rollers on the one hand and the pressing rollers on the other hand. Those protective devices are intended on the one hand to prevent the screening belts from coming to a stop, while on the other hand insuring optimum adaptation to different kinds and qualities of fruit and amounts of mash.

When dealing with greatly different amounts of fruit, the layer of mash is also of different thicknesses in the high-pressure pressing region. In such a case the arresting pins or securing pin members are removed on the described arresting plates and a defined counterpressure is built up by the bellows cylinders so that the pressure of the line gaps, which acts on the varying thickness of mash, remains the same.

When dealing with soft fruit, for example, line pressure is not desired. In that case the pressure rollers are arrested in the so-called rest position by the arresting plates and then, operating as normal pressing rollers, do not generate any line pressure.

Encasing the pressing rollers with a yielding covering is also of significance in accordance with the invention. Since, as stated, the layer of mash enclosed between the screening belts is not exactly equal over the entire width and has a wavy surface, that arrangement provides for more uniform distribution of pressure over the entire width in the line pressure gap, by virtue of the yielding encasing covering.

It will be seen that the apparatus according to the invention provides in particular the following advantages:

a saving on rollers in the press structure;

achieving higher line pressures and a higher level of output which is linked thereto; and additional belt tensioning and support for the belt tensioning system.

Referring to the drawings, in a screening belt press 10 for pressing out fruit mash, two screening belts 12 and 14 are guided around a plurality of rollers which are mounted in a machine frame 16. In addition, beneath pressing zones, the machine frame 16 carries catch troughs 18 or the like collecting vessels for juice which issues.

At the left-hand side in FIG. 1, downstream of a direction-changing roller 20, the lower screening belt 14 forms a receiving zone A for the fruit mash which is supplied through a feed device 22 and onto which the upper screening belt 14 is then applied in the region of a wedge-shaped gap 24. At that location the upper screening belt 14 partially extends around the periphery of a direction-changing roller 26.

From the wedge-shaped gap 24 the pair of screening belts 12/14 move, along support tubes indicated at 28, to drums 30 to 35 which are of diameters d which decrease upwardly. The drums 30 to 35 guide the screen belts 12/14 in a plurality of successive pressing zones B, C and D of S-shaped contours in cross-section, in an upward direction.

Adjoining the uppermost drum 35 downstream of a guide roller 36 is a high-pressure pressing zone E with the screening belts 12 and 14 which are directed substantially horizontally in the zone E but which are laid in a meander-like configuration over pressing rollers 38, 40 and 42 and pressure rollers 39 and 41. The screening belts 12 and 14 then separate, running over drive rollers **44*a* and 44*b*, in order to return individually to the wedge-shaped gap 24**.

Downstream of the pressing rollers 38, 40 and 42 the lower screening belt 12 passes over a drive roller **44*a* of a drive 46, a belt cleaning device 48*a* and further direction-changing rollers 20*a*. The upper screening belt 14 is also guided by direction-changing rollers 26*b* and is passed around a roller identified by reference numeral 47 in a belt cleaning device 48*b*. The drawing does not particularly show that some of the direction-changing rollers 20*a* and 26*b*** are adapted to be radially displaceable for the purposes of adjusting the belt tension.

Figure 2:
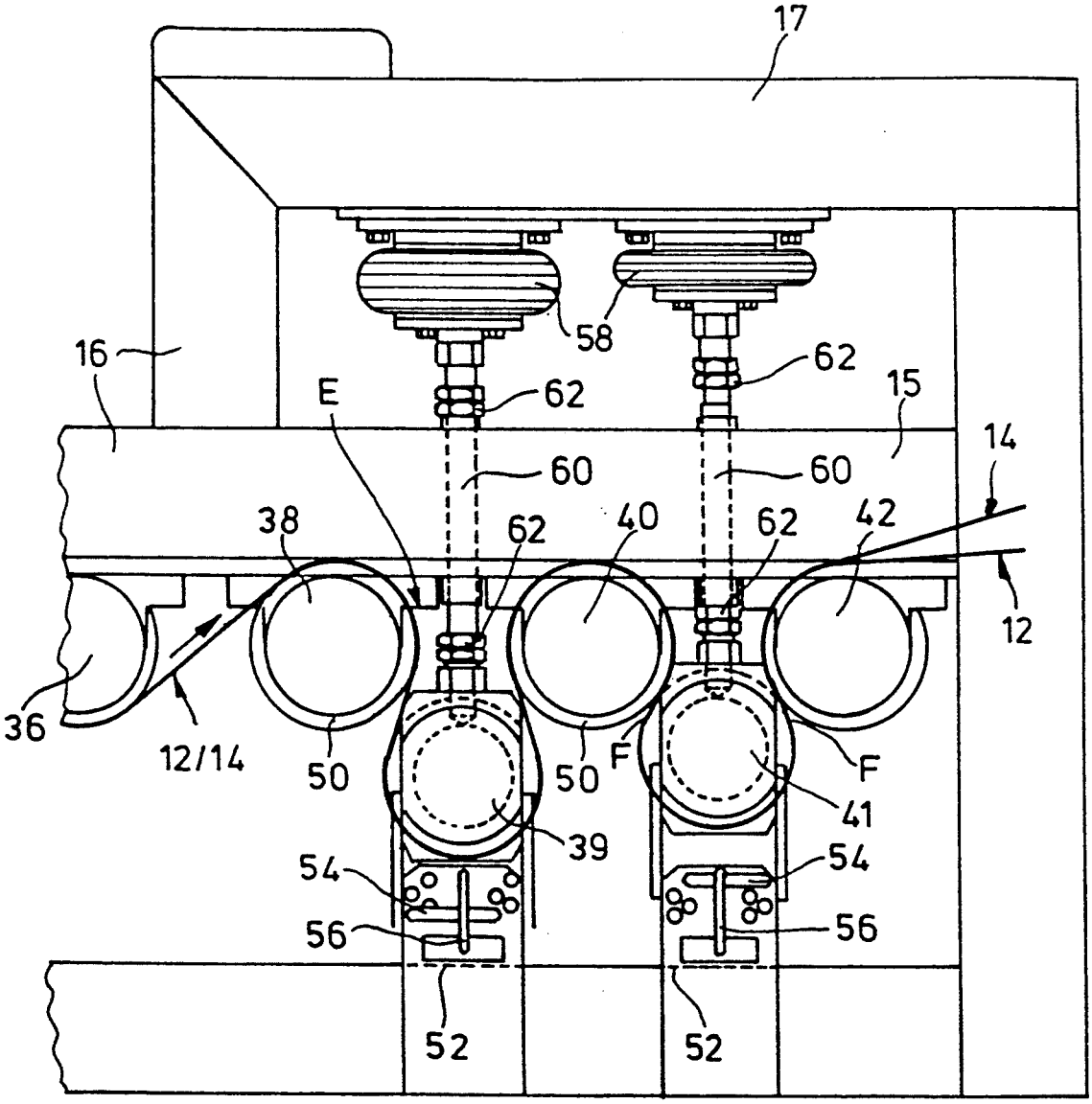
FIG. 2 is a diagrammatic view of a portion from FIG. 1 as indicated by the arrow II therein in the region of the high-pressure pressing zone, on an enlarged scale.

The pressing rollers 38, 40 and 42 of the high-pressure pressing zone E which is shown in FIG. 2 are provided with an elastic peripheral surface, as a rubber casing 50 of limitedly flexible material, and are mounted stationarily in the machine frame 16. The freely suspended pressure rollers 39 and 41 can move vertically between a rest position (position I) indicated in FIG. 2 in respect of the pressure roller 39, and a pressing position (position II) illustrated in respect of the pressure roller 41.

When the screening belt press 10 is switched on and the screening belts 12 and 14 are tensioned, the pressure rollers 39, 41, as a result of the screening belt tension, move upwardly out of their lower rest position which is produced by virtue of their own weight, towards the pressing rollers 38, 40 and 40, 42 respectively, into the pressing position. In that position, two line pressure gaps F which are indicated in FIG. 2 at the pressure roller 41 are respectively formed between the pressure roller 39 and 41 respectively on the one hand and the pair of pressing rollers 38, 40 and 40, 42 respectively associated therewith, on the other hand.

The screening belts 12 and 14 must squeeze through the line pressure gap F, with the layer of mash which is enclosed between them.

In order to insure that the screening belts 12 and 14 do not stop due to the forces which are produced in the line pressure gaps F and which can then be greater than the drive forces transmitted to the screening belts 12 and 14 by way of the drive rollers **44*a* and 44*b* apertured arresting plates 52 are installed beneath the pressure rollers 39 and 41 in which the pressure rollers 39, 41 can be held at defined spacings relative to the stationary pressing rollers 38, 40, 42 by connecting pins 54. Additional securing pin members 56 prevent the connecting pins 54** from slipping out.

Provided as a further protective arrangement are pneumatic bellows cylinders 58 carried on a yoke 17 of the machine frame 16. The cylinders 58 act with guide rods or bars 60 on the pressure rollers 39, 41 and apply defined counter-pressures to the two freely suspended pressure rollers 39, 41 which are drawn upwardly by the screening belts 12 and 14.

Lock nuts 62 carried on the guide rods or bars 60 cooperate as adjustable abutment elements with a transverse beam member 15 of the machine frame 16, which can be seen in FIG. 2. In position I the upper lock nuts 62 are in an abutment condition while in position II it is the lower lock nuts 62 that are in the abutment condition. In that way, the above-mentioned positions I and II can be exactly adjusted.

We claim:

1. Apparatus which comprises:

circulating screening belts of a screening belt press for producing juice from a layer of fruit mash therebetween;

at least one of drums and rollers guiding the screening belts therearound in at least one pressing zone forming a meander-like pressing path;

a high pressure pressing zone including at least one pair of stationary pressing rollers and at least one pressure roller, wherein the screening belts are guided in the high-pressure pressing zone around both the at least one pair of pressing rollers and the at least one pressure roller, between said at least one pair of pressing rollers and said at least one pressure roller, wherein said pressure roller is linearly toward and away from the pressing rollers; and means for linearly moving the at least one pressure roller into a pressing position wherein the at least one pressure roller forms with each of the pressing rollers a line pressure gap which acts on the cross-section of the layer of fruit mash.

2. Apparatus according to claim 1 including means for providing a rest position of the at least one pressure roller in which it is disposed at a spacing relative to the pressing rollers.

3. Apparatus according to claim 2 wherein the at least one pressure roller is held in the rest position under the weight of the at least one pressure roller.

4. Apparatus according to claim 1 including means for tensioning the screening belts and wherein the at least one pressure roller can be moved into the pressure position by the tensioning of the screening belts.

5. Apparatus according to claim 1 wherein at least one of the pressing rollers of the screening belt press is provided with an electric peripheral surface.

6. Apparatus according to claim 1 wherein the at least one pressure roller is freely suspended and is connected to a force storage means which applies a defined counter-force to the freely suspended pressure roller, wherein the freely suspended pressure roller can be drawn upwardly by the screening belts.

7. Apparatus according to claim 6 including at least one connecting member connected between the force storage means and the at least one pressure roller, said at least one connecting member including adjusting devices, wherein the positions of the pressure roller are adjustable with said adjusting devices.

8. Apparatus according to claim 7 including a bellows cylinder as the force storage means, with a guide bar as the connecting member on which nuts are adjustably arranged as the adjusting devices, the nuts cooperating with a counterpart abutment.

9. Apparatus according to claim 8 including a machine frame for said apparatus, wherein the counterpart abutment is a transverse beam member of the machine frame.

10. Apparatus according to claim 1 including arresting means with an arresting surface which is associated with the at least one pressure roller and in which the pressure roller is held by connecting pins at a defined spacing relative to the pressing rollers.

11. Apparatus according to claim 10 including securing pin members connected to said arresting means for securing the connecting pins in position.

* * * * *

UNITED STATES PATENT AND TRADEMARK OFFICE

CERTIFICATE OF CORRECTION

PATENT NO. : 5,309,829

DATED : May 10, 1994

INVENTOR(S) : Martin Gahlmann et al.

It is certified that error appears in the above-identified patent and that said Letters Patent is hereby corrected as shown below:

In Column 1, line 17, after "discharge gap" insert --in which are disposed a plurality of--.

In Column 1, line 18, after "mutually" delete "in which are disposed a plurality of".

In Column 1, line 56, after "rollers around" insert --a--.

In Column 2, line 26, change "envisage" to read --envisaged--.

In Column 4, claim 1, line 58, before "toward and away" --movable-- should be inserted.

In Column 5, claim 4, line 6, "pressure" should read --pressing--.

In Column 5, claim 5, line 10, "electric" should read --elastic--.

Signed and Sealed this

Eleventh Day of October, 1994

*Attest:*

Bruce Lehman

BRUCE LEHMAN

*Attesting Officer*

*Commissioner of Patents and Trademarks*